US005802671A

United States Patent [19]

Ikuma

[11] Patent Number: 5,802,671

[45] Date of Patent: Sep. 8, 1998

[54] VIBRATION-PREVENTING DEVICE FOR A DOOR IN A VEHICLE

[75] Inventor: Masahiro Ikuma, Shizuoka-Ken, Japan

[73] Assignee: Suzuki Motor Corporation, Shizuoka-ken, Japan

[21] Appl. No.: 760,401

[22] Filed: Dec. 4, 1996

[30] Foreign Application Priority Data

Jan. 30, 1996 [JP] Japan ..... 8-013442

[51] Int. Cl.[6] ..... E05F 5/06

[52] U.S. Cl. ..... 16/85; 16/82; 16/DIG. 6

[58] Field of Search ..... 16/85, 82, 86 R, 16/86 A, DIG. 6; 292/341.12, 216, 340, DIG. 15, DIG. 73, DIG. 59, DIG. 56

[56] References Cited

U.S. PATENT DOCUMENTS

| | | | |
|---|---|---|---|
| 1,890,275 | 12/1932 | Wirth | 16/DIG. 6 |
| 2,143,266 | 1/1939 | Grondahl | 16/DIG. 6 |
| 4,302,864 | 12/1981 | Morita | 16/85 |
| 5,010,622 | 4/1991 | Morita | 16/82 |

FOREIGN PATENT DOCUMENTS

| | | | |
|---|---|---|---|
| 207289 | 1/1960 | Germany | 16/85 |
| 916754 | 1/1963 | United Kingdom | 16/DIG. 6 |

*Primary Examiner*—Chuck Mah

*Attorney, Agent, or Firm*—Morrison Law Firm

[57] ABSTRACT

The present invention is structured so that a guide pin will be captured within holes disposed on opposite walls of a case. A stopper wedge piece having a contact surface rides on the guide pin at one end of the case while a spring is disposed on the guide pin at the other end of the case. The guide pin has a collar close to one end that prevents the spring from slipping off that end of the guide pin. The collar also prevents the guide pin from passing through the hole at that end of the case. The spring keeps the stopper wedge pressed toward one side of the case while at the same time keeps the guide pin collar pressed toward the other side of the case. A metal plate pressed into the bottom of the case prevents wear of the case as the stopper wedge rides against the bottom plate during use. Assembly is facilitated by a downward incline toward the outside is formed on the lower portion of the hole on the case wall into which the stopper end of the guide pin is inserted. The steps of assembly include first pressing the bottom liner plate into the case. Second, slide the spring onto the stopper end of the guide pin until it contacts the collar. Third, slide the stopper wedge onto the guide pin, compressing the spring. Fourth, insert the stopper end of the guide pin through the hole at the stopper end of the case beyond its final position, taking advantage of the outward bevel to insert the guide pin at an incline. Finally, swing the collar end of the guide pin into alignment with the opposite hole, and allow the spring to urge the end of the guide pin into the hole until the collar contacts the wall of the case.

12 Claims, 5 Drawing Sheets

VIBRATION-PREVENTING DEVICE FOR A DOOR IN A VEHICLE

BACKGROUND OF THE INVENTION

The present invention relates to a vibration-preventing device for a door or other opening/closing body in a vehicle such as, for example, an automobile. More specifically, the present invention relates to a vibration-preventing device for a closed vehicle door, wherein; a small spring-loaded block, wedged between the door and its frame, prevents the door from vibrating.

An environment within which a vibration-preventing device is installed, includes at least one vibration-preventing device attached to a side wall of an opening for a door. When the door is closed, the vibration-preventing device maintains contact with a contact point on door by exerting a pressure that prevents the door from vibrating.

One option for a vibration-preventing device includes a case attached to the side wall. First and second end walls extend upward from a bottom of the case. The end walls are spaced a distance apart. A metal plate is adhered to the bottom of the case. The metal plate prevents wear of the bottom of the case during use. A guide pin extends between the end walls to span the bottom of the case. A spring biased stopper wedge is slidable on the guide pin. When the door is open, the spring biased stopper wedge is at rest against the first end wall. When the door is closed, the contact point of the door moves the spring biased stopper wedge, against its biasing, along the guide pin towards the second end wall. During use, if the door is loose enough to rattle during vehicle motion, the spring biasing moves the spring biased stopper wedge back towards the first end wall so the spring biased stopper wedge maintains contact with the contact point of the door, and thereby take up any looseness which might otherwise permit rattling.

During assembly of the vibration-preventing device, the metal plate is adhered to the bottom of the case with an adhesive material such as two-sided tape or the like. The metal plate prevents the sliding of the stopper wedge from wearing the bottom of the case. Next, the spring biased stopper wedge is slidably mounted on the guide pin which, in turn, is fixed between the first and second end walls. The guide pin is held against the first end wall by an adhesive that fixes it in place.

While the above vibration-preventing device prevents vibration, one shortcoming of the above vibration-preventing device is that a first end of the guide pin is caulked with adhesive to fix it to the first end wall of the case. Consequently, a caulking operation is needed, resulting in an increased number of assembly steps. The assembly procedure is made even more difficult by the fact that a second end of the guide pin must be stabilized in place while the first end is caulked.

A second shortcoming of the above vibration-preventing device is that the metal plate is fixed to the case using an adhesive material. This results in extra costs such as the cost of the adhesive material. Furthermore, the adhesion process increases the number of steps in assembly. Also, the adhesive surfaces of the case and the metal plate must be prepared prior to application of the adhesive material. Such surface preparation steps, for example, de-greasing and/or priming, results in an increased complexity of assembly.

OBJECTS AND SUMMARY OF THE INVENTION

It is an object of the present invention is to overcome the drawbacks of the prior art.

It is a further object of the invention, to provide a vibration-preventing device for an opening/closing body in an automobile that allows simple and quick installation onto the case of the guide pin and the metal plate.

It is a still further object of the invention to provide a vibration-preventing device with simplified installation of a metal plate which reduces wear between mutually sliding parts.

Briefly stated, the present invention provides that a guide pin is captured within holes disposed on opposite walls of a case. A stopper wedge piece having a contact surface rides on the guide pin at one end of the case while a spring is disposed on the guide pin at the other end of the case. The guide pin has a collar close to one end that prevents the spring from slipping off that end of the guide pin. The collar also prevents the guide pin from passing through the hole at that end of the case. The spring keeps the stopper wedge pressed toward one side of the case while at the same time keeps the guide pin collar pressed toward the other side of the case. A metal plate pressed into the bottom of the case prevents wear of the case as the stopper wedge rides against the bottom plate during use. Assembly is facilitated by a downward incline toward the outside is formed on the lower portion of the hole on the case wall into which the stopper end of the guide pin is inserted. The steps of assembly include first pressing the bottom liner plate into the case. Second, slide the spring onto the stopper end of the guide pin until it contacts the collar. Third, slide the stopper wedge onto the guide pin, compressing the spring against the collar. Fourth, insert the stopper end of the guide pin through the hole at the stopper end of the case beyond its final position, taking advantage of the outward bevel to insert the guide pin at an incline. Finally, swing the collar end of the guide pin into alignment with the opposite hole, at the collar side of the case, and allow the spring to urge the end of the guide pin into the hole until the collar contacts the wall of the case.

According to an embodiment of the invention, there is provided a vibration-preventing device for an opening/closing body in an vehicle comprising; a guide pin spanning a case, said guide pin passing through a stopper wedge and a spring in said case, a stopper end and a collar end of said guide pin captured in said case in two holes disposed on opposite side walls of said case, said stopper wedge and said spring contacting said collar end of said guide pin, said spring urging said guide pin toward a collar side wall of said case, an incline formed downward and outward on a lower portion of said hole in a stopper side wall of said case through which a stopper end of said guide pin is inserted, and a contact surface is formed toward a collar end of said guide pin contacting said collar side wall of said case.

According to another embodiment of the invention, there is provided a vibration-preventing device comprising; a guide pin having a collar, a stopper end, and a collar end, said stopper end disposed in a stopper hole, said collar end disposed in a collar contact hole, said collar substantially larger than said collar contact hole, said guide pin spanning a distance between said stopper hole and said collar contact hole, a stopper wedge slidably disposed on said guide pin, and a spring disposed on said guide pin between said stopper wedge and said collar, said spring simultaneously urging said stopper wedge toward said stopper hole and said collar toward said collar contact hole.

According to another embodiment of the invention, there is provided a vibration-preventing device comprising; a guide pin having a collar, a stopper end, and a collar end, said stopper end disposed in a stopper hole, said collar end disposed in a collar contact hole, said collar substantially larger than said collar contact hole, said guide pin spanning a distance between said stopper hole and said collar contact hole, a stopper wedge slidably disposed on said guide pin, a spring disposed on said guide pin between said stopper wedge and said collar, said spring simultaneously urging said stopper wedge toward said stopper hole and said collar toward said collar contact hole. A case having a wear resistant bottom, a stopper end-wall, and a collar end-wall, said stopper hole disposed in said stopper end-wall, and said collar contact hole disposed in said collar end-wall.

According to yet another embodiment of the invention, there is provided a vibration-preventing device comprising; a guide pin having a collar, a stopper end, and a collar end, said stopper end disposed in a stopper hole, said collar end disposed in a collar contact hole, said collar substantially larger than said collar contact hole, said guide pin spanning a distance between said stopper hole and said collar contact hole, a stopper wedge slidably disposed on said guide pin, a spring disposed on said guide pin between said stopper wedge and said collar, said spring simultaneously urging said stopper wedge toward said stopper hole and said collar toward said collar contact hole, and said wear resistant bottom is a metal plate press-fit into said case.

According to yet another embodiment of the invention, there is provided a vibration-preventing device, comprising; a stopper wedge having a wedge shape, a thin end, and a thick end, a guide pin, said guide pin having an axis, a collar, a stopper end, and a collar end, a collar contact hole, said collar end of said guide pin disposed in said collar contact hole, said stopper wedge slidable along a path defined by said axis of said guide pin, at least one spring having a stopper contact end and a collar contact end, said stopper contact end of said spring contacting said thick end of said stopper wedge, and said spring biased to urge said guide pin into said collar contact hole while simultaneously urging said stopper to slide along said path in a direction lead by said thin end of said stopper wedge.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
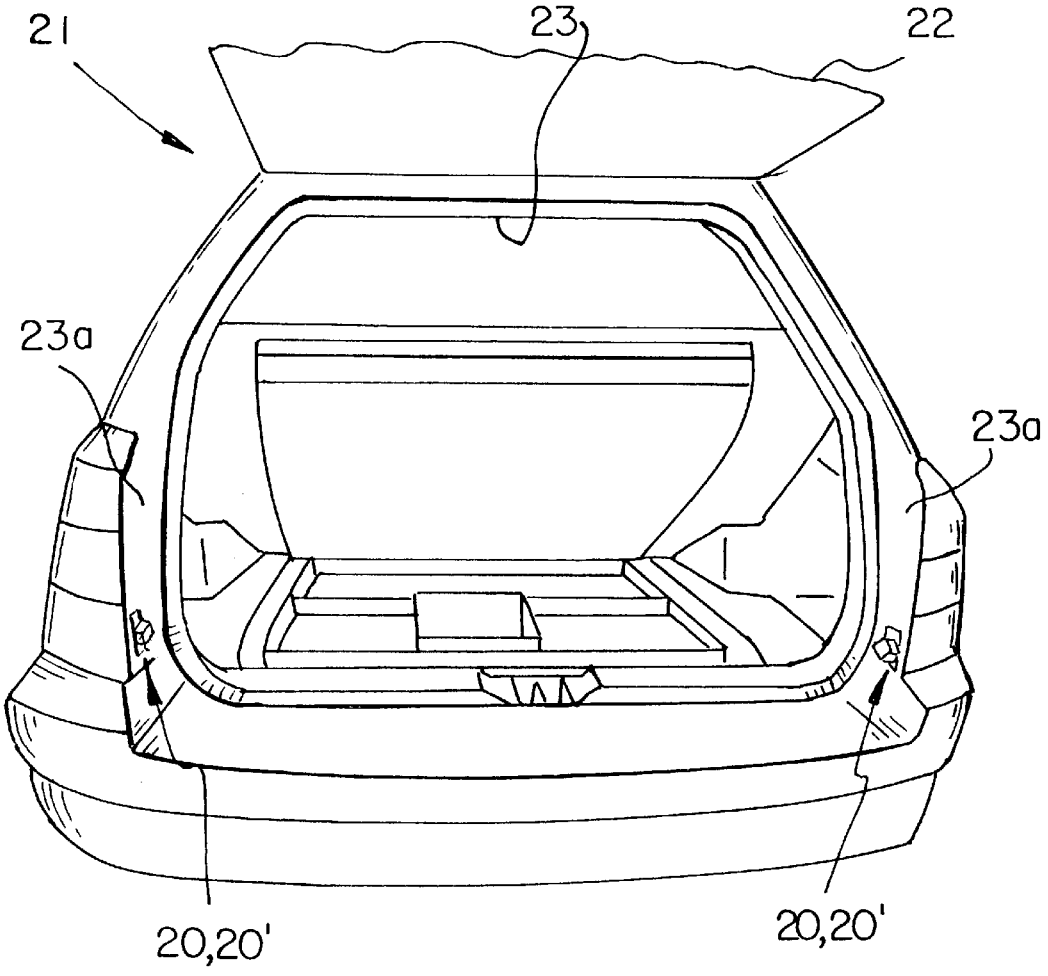
FIG. 1 is a perspective drawing showing the rear portion of an automobile in which an embodiment of the present invention is used.

Referring first to FIG. 1, an environment within which a vibration-preventing device is installed, includes at least one vibration-preventing device 20' attached to a side wall 23*a* of an opening 23 for a door 22, shown here as the rear hatch door of an automobile 21. When door 22 is closed, vibration-preventing device 20' maintains contact with a contact point on door 22 by exerting a pressure that prevents door 22 from vibrating.

Figure 10:
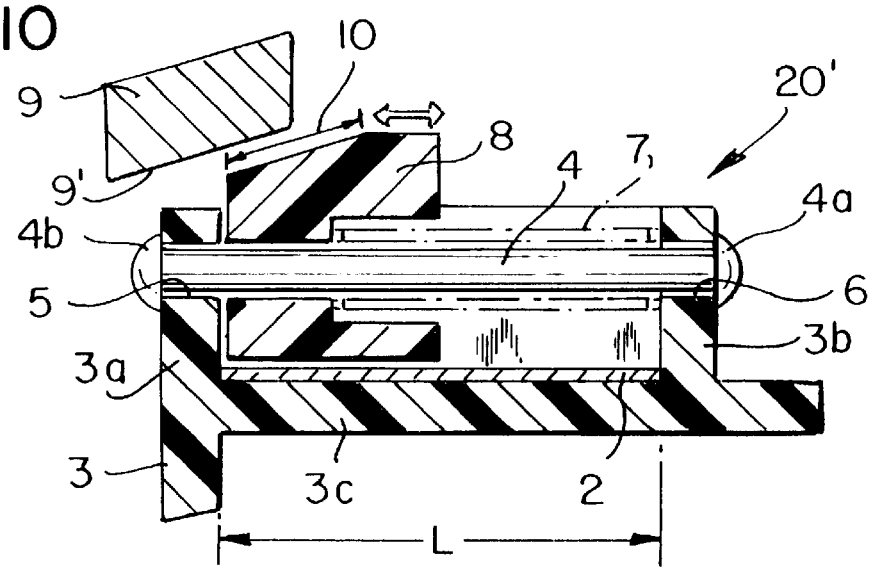
FIG. 10 is a cross-section drawing showing the main elements of a vibration-preventing device.

Referring to FIG. 10, one option for a vibration-preventing device 20' includes a case 3 attached to side wall 23*a*. First and second end walls 3*a* and 3*b* extend upward from a bottom 3*c* of case 3. End walls 3*a* and 3*b* are spaced a distance 1 apart. A metal plate 2, also having a length I (FIG. 11), is adhered to bottom 3*c*. Metal plate 2 prevents wear of bottom 3*c* during use, as will be explained. A guide pin 4 extends through holes 5 and 6 in end walls 3*a* and 3*b*, respectively to span bottom 3*c*. A stopper wedge 8 is slidable on guide pin 4. A spring 7, shown as a spiral spring, is threaded on guide pin 4. Guide pin 4 is spread at its ends 4*a* and 4*b* to retain ends 4*a* and 4*b* in case 3. Spring 7 urges stopper wedge 8 toward end wall 3*a*. Stopper wedge 8 includes an inclined upper sliding surface 10. An inclined surface 9' of contact point 9, affixed to move with door 22 (FIG. 1), is inclined at about the same angle as inclined upper sliding surface 10. When door 22 is closed, inclined surface 9' moves rightward into contact with inclined upper sliding surface 10 of stopper wedge 8.

Normally, the fit of door 22 is such that, when inclined surface 9' contacts inclined upper sliding surface 10, stopper wedge 8 is moved part of the way rightward along guide pin 4, against the urging of spring 7. During use, if door 22 is loose enough to rattle during vehicle motion, spring 7 forces stopper wedge 8 leftward to wedge under inclined surface 9', and thereby take up any looseness which might otherwise permit rattling.

Figure 11:
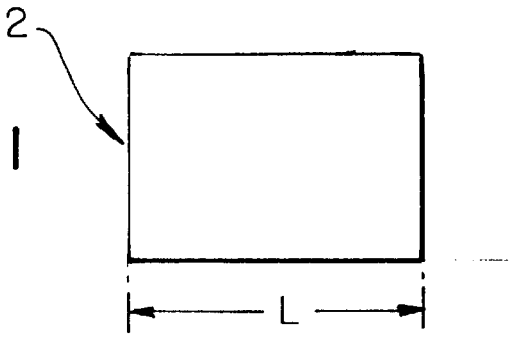
FIG. 11 is a plan drawing showing the metal plate of the vibration-preventing device of FIG. 10.

Metal plate 2, shown in both FIGS. 10 and 11, is roughly rectangular having the same size and shape as bottom 3*c*. Metal plate 2, which has length 1 that is roughly equal to distance 1 between end walls 3*a* and 3*b*.

During assembly of the apparatus, metal plate 2 is adhered to bottom 3*c* of case 3 with adhesive material, two-sided tape or the like. Metal plate 2 prevents the sliding of stopper wedge 8 from wearing bottom 3*c* of case 3. Next, guide pin 4 is inserted through hole 5, then through spring 7, stopper wedge 8, and hole 6 though wall 3*b* of case 3. Stopper wedge 8 preferably is made from resin. Guide pin 4 is held against end wall 3*a* by an adhesive that fixes it in place.

While above vibration-preventing device 20' reduces vibration, one shortcoming of above vibration-preventing device 20' is that end 4*b* of guide pin 4 is caulked with adhesive to fix end 4*b* to case 3. Consequently, a caulking operation is needed, resulting in an increased number of assembly steps. The assembly procedure is made even more difficult by the fact that first end 4*a* of guide pin 4 must be stabilized in place while end 4*b* is caulked.

A second shortcoming of above vibration-preventing device 20' is that metal plate 2 is fixed to case 3 using an adhesive material. This results in extra costs for, for example, the adhesive material. Furthermore, the adhesion process increases the number of steps in assembly. Also, the adhesive surfaces of case 3 and metal plate 2 must be prepared prior to application of the adhesive material. Such surface preparation steps, for example, de-greasing and/or priming, results in an increased complexity of assembly.

Figure 2:
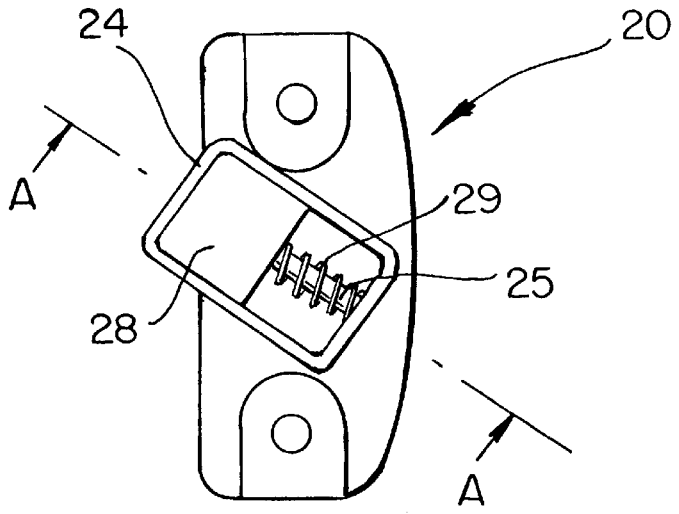
FIG. 2 is a side view showing the main elements of a vibration preventing device according to an embodiment of the present invention.

Referring to FIG. 2, vibration-preventing device 20 has a case 24 capturing a spring loaded stopper wedge 28. Stopper wedge 28 is slidably captured in case 24 on a guide pin 25. A spring 29 biased between an end of case 24 and an end of stopper wedge 28 urges stopper wedge leftward in the drawing. Case 24 is advantageously oriented to provide optimal contact between stopper wedge 28 and door 22 whenever door 22 is closed. As door 22 closes, a contact point (not shown) movable therewith, contacts stopper wedge 28. This contact slides stopper wedge 28 axially along guide pin 25 against the force of spring 29, as in the prior-art embodiment of FIG. 10.

In operation, the embodiment of vibration-preventing device 20 of FIG. 2 operates in the same manner as vibration-preventing device 20' of FIG. 10. Thus, operation of vibration-preventing device 20 will not be discussed further.

Figure 5:
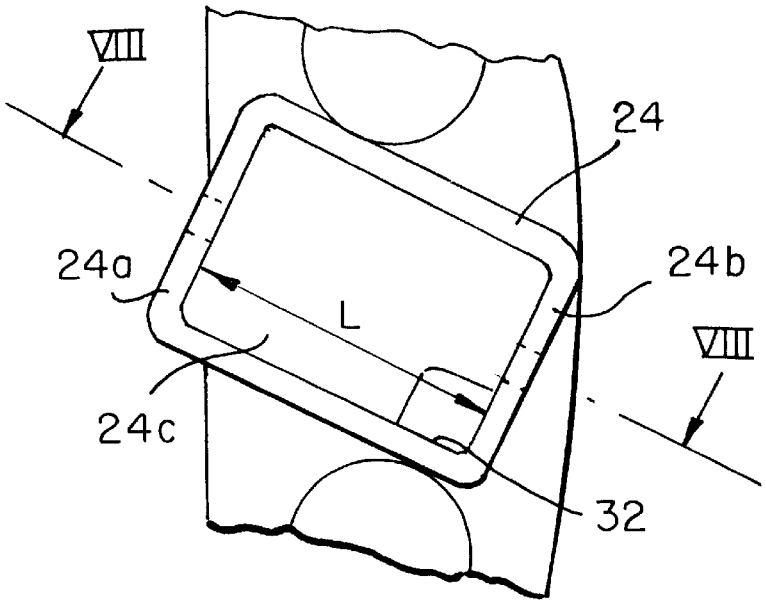
FIG. 5 is a side view showing the case of an embodiment of the present invention.

Assembly of vibration-preventing device 20 is now described. Referring first to FIG. 5, case 24 has a stopper end wall 24*a* and a collar end wall 24*b* spaced distance 1 apart, the same length as a bottom 24*c*. A drainage hole 32 is disposed in a lower right corner to prevent accumulation of moisture in case 24.

Figure 7:
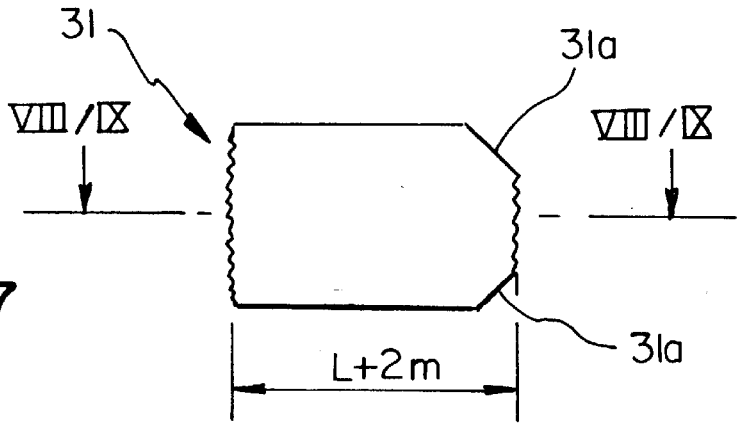
FIG. 7 is a plan view of the metal plate of an embodiment of the present invention.

Referring next to FIG. 7, a metal plate 31, having a length 1+2m, is to be disposed into case 24 (FIG. 5) in contact with bottom 24*c*. The ends of metal plate 31 have a sawtooth shape to allow embedding in side walls 24*a* and 24*b*. One end of metal plate 31 has corners 31*a* that are beveled to reduce resistance to embedding in collar end wall 24*b* when metal plate 31 is pressed into place during assembly.

Figure 8:
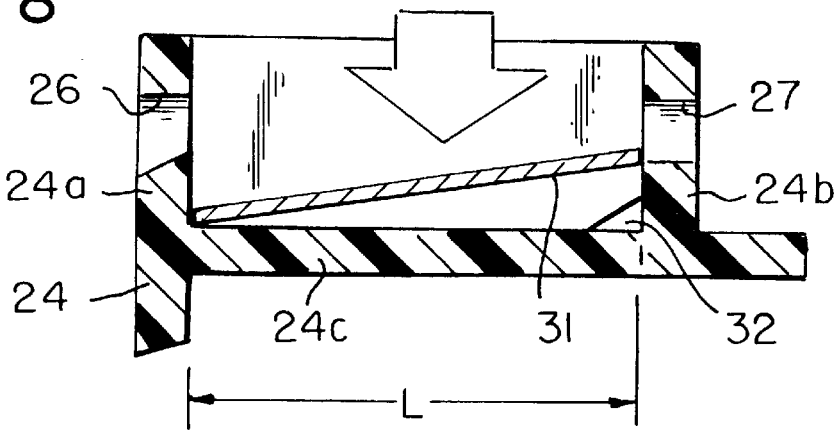
FIG. 8 is a cross-section drawing combining FIG. 5, line VIII, and FIG. 7, line VIII/IX, illustrating the main elements of an embodiment of the present invention; showing the state of assembly before the metal plate is pressed into final position.

Referring next to FIG. 8, metal plate 31 is in position in case 24 prior to being pressed into final contact with bottom 24*c*. In this position, the end opposite bevels 31*a*,31*a* abuts stopper end wall 24*a* at the point where stopper end wall 24*a* intersects bottom 24*c*. The beveled end of metal plate 31 is wedged against collar end wall 24*b*. Since metal plate 31 is 2 m longer that the distance 1 spanning stopper end wall 24*a* and collar end wall 24*b*, metal plate 31 cannot lay flat against bottom 24*c*. Therefore to achieve the desired final position metal plate 31 must be pressed in the direction of the arrow.

Figure 6:
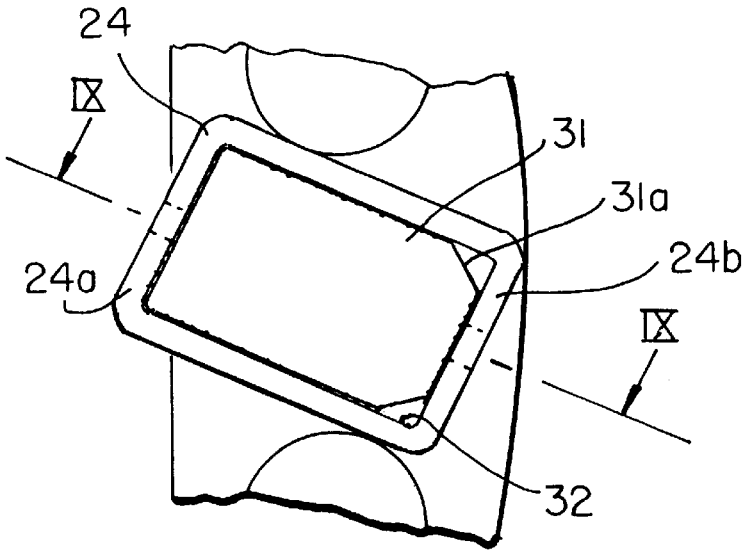
FIG. 6 is a side view showing the case of an embodiment of the present invention.
Figure 9:
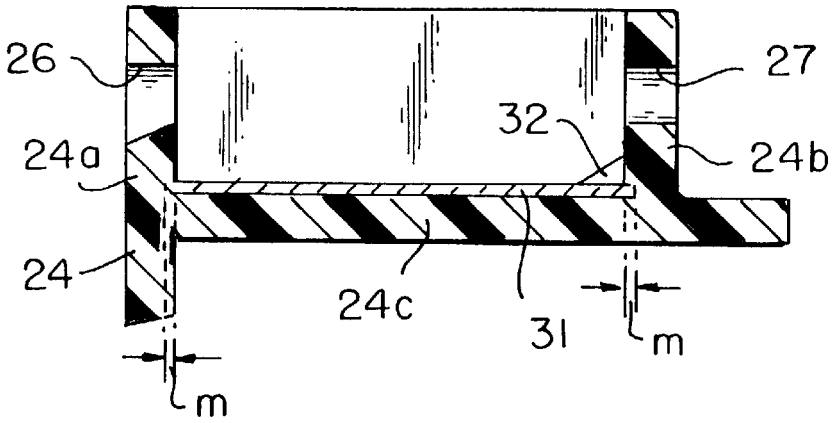
FIG. 9 is a cross-section drawing combining FIG. 5, line IX, and FIG. 7, line VIII/IX, illustrating the main elements of an embodiment of the present invention; showing the state of assembly after the metal plate is pressed into final position.

Referring next to FIGS. 6 and 9, metal plate 31 is illustrated in final assembled position adjacent to, and in contact with bottom 24*c*. One end of metal plate 31 is embedded distance m into stopper end wall 24*a* and the other end of metal plate 31 is embedded distance m into collar end wall 24*b*. Since both ends of metal plate 31 are embedded into case 24, metal plate 31 is attached to the bottom of case 24. Therefore, no adhesive is required eliminating the adhesion steps of the above vibration-preventing device 20' for adhering metal plate 2 (FIG. 11) in case 3 (FIG. 10). Case 24 with metal plate 31 is now prepared for assembly of the vibration-preventing mechanism.

Figure 3:
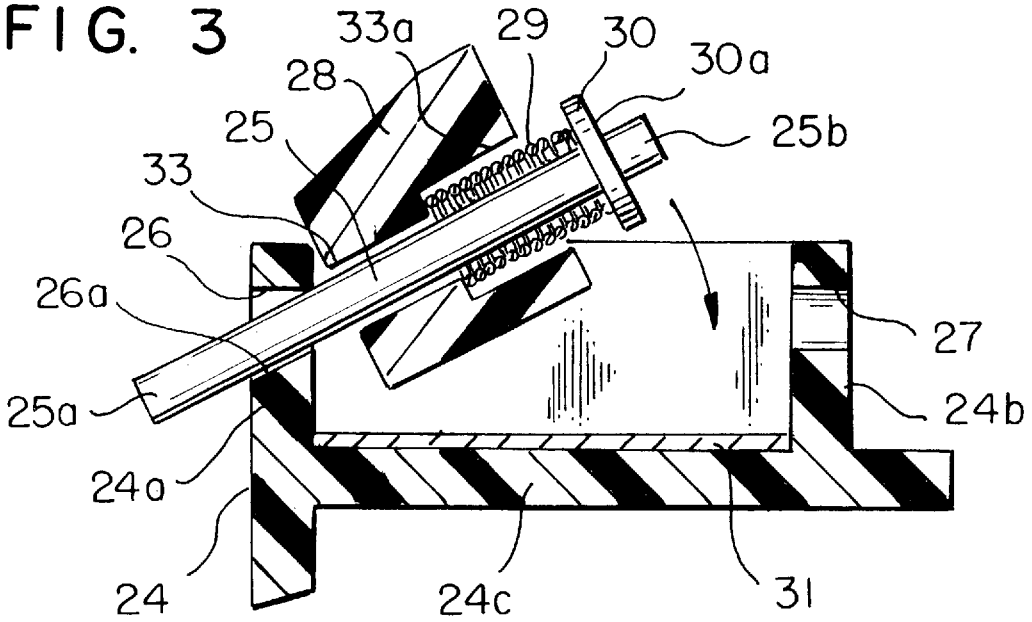
FIG. 3 is a cross-section taken along A—A in FIG. 2 showing the main elements of an embodiment of the present invention during the process of assembly before the guide pin and the components thereon have been finally captured in final position in the case.

Referring next to FIG. 3, collar end wall 24*b* of case 24 has a hole 27 disposed therein. In opposite alignment with hole 27, a hole 26 is disposed in stopper end wall 24*a*. Hole 26 has a downwardly outwardly angled lower portion 26*a*Lower portion 26*a* allows guide pin 25 to pass through hole 26 at an angle during assembly.

Guide pin 25 has a collar 30 fixed close to a collar end 25*b*Spring 29 abuts against collar 30. Collar 30 is of such a diameter that spring 29 cannot pass over it. The diameter of collar 30 is also such that it cannot pass through hole 27. Rather, after assembly a contact surface 30*a*of collar 30, will contact collar end wall 24*b* at the depth that collar end 25*b* inserts into hole 27. There is no collar on the opposite end of guide pin 25, a stopper end 25*a*

A hole 33 in stopper wedge 28 allows guide pin 25 to pass through. Stopper wedge 28 slides on guide pin 25, to function as described above. An optional countersunk portion 33*a* of hole 33 accommodates spring 29. Optimally, countersunk portion 33*a* has a depth approximately equal to the length of spring 29 when spring 29 is fully compressed.

Figure 4:
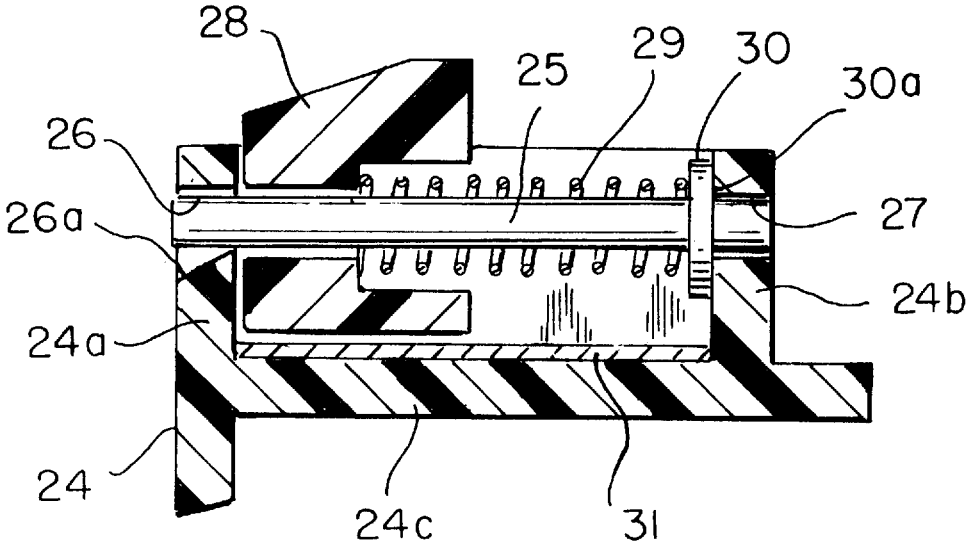
FIG. 4 is a cross-section taken along A—A in FIG. 2 showing the main elements of an embodiment of the present invention fully assembled after the guide pin and the components thereon have been finally captured in final position in the case.

For assembly, referring to FIGS. 3 and 4, spring 29 is threaded onto stopper end 25*a* of guide pin 25 until is contacts collar 30. Next stopper wedge 28 is threaded onto stopper end 25*a* until stopper wedge 28 contacts spring 29, with spring 29 inserted into countersunk portion 33*a*. Next, stopper end 25*a* is angularly inserted into hole 26 at an angle and passed through hole 26 along lower portion 26*a*As guide pin 25 passes through hole 26, stopper wedge contacts stopper end wall 24*a*. Further movement of guide pin 25 through hole 26 causes spring 29 to be compressed. When spring 29 is compressed enough, collar end 25*b* of guide pin 25 becomes capable of being swung downward. Therefore, while maintaining the compression on spring 29, collar end 25*b* is swung, as indicated by the arrow in the drawing, until it aligns with hole 27. Once in alignment the compression is released and spring 29 urges collar end 25*b* into hole 27 until contact surface 30*a* of collar 30 abuts against collar end wall 24*b* of case 24. This engagement is maintained thereafter.

In this assembled configuration stopper wedge 28 is kept toward stopper end wall 24*a* of case 24 by spring 29. No caulking of guide pin 25 is required during the assembly operation. This reduces the number of steps involved in installation. Also, there is no need to fixedly secure stopper end 25*a* of guide pin 25 in place, thus simplifying installation.

Figure 12:
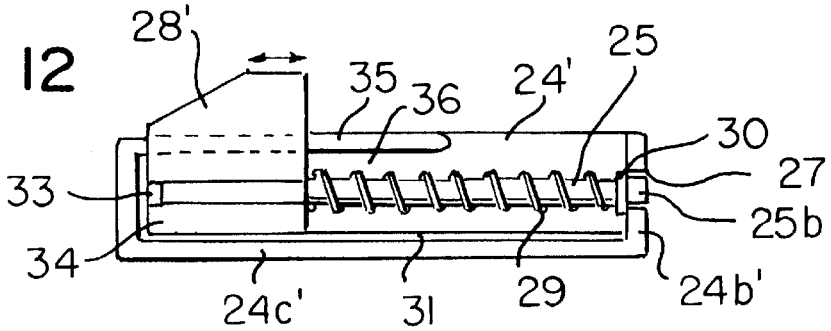
FIG. 12 is a cross-section drawing of the main elements of another embodiment of the present invention.
Figure 13:
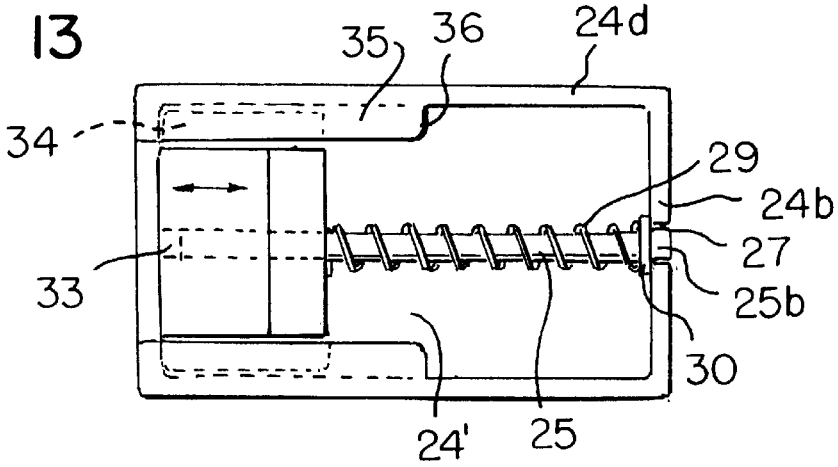
FIG. 13 is a top view drawing of the main elements of the embodiment of the present invention shown in FIG. 12.

Referring next to FIGS. 12 and 13, a stopper 28' of another embodiment is threaded onto guide pin 25. Like the above embodiment of a stopper mechanism, the embodiment of FIGS. 12 and 13 also utilizes a compression of the spring for insertion of the mechanism into the case. However in this embodiment, a case 24' is lacking hole 26 and substitutes, instead, a guide channel 36 is formed on each side wall 24*d* of case 24'. Guide channel 36 is defined by bottom 24*c*' and a case ridge 35. Each case ridge 35 runs part way along the top edge of side 24*d*. The remainder of side 24*d* has no case ridge 35 to allow stopper 28' to be inserted into case 24' during assembly. Guide pin 25 in this embodiment is slightly shorter then the distance 1 (FIG. 5). A guide tab 34 on each side of stopper 28' slides in guide channel 36 thereby retaining stopper 28' in case 24'. Since stopper wedge 28' is slidably held in position in case 24' by the guide channels 36 there is no need for hole 26 to stabilize the stopper end of guide pin 25.

This embodiment therein retains the advantage of assembly without the guide pin to the case. This embodiment has the added advantage of allowing the stopper wedge to more freely contact bottom 24*c*' and contact surface 30*a* under pressure of spring 29.

Figure 14:
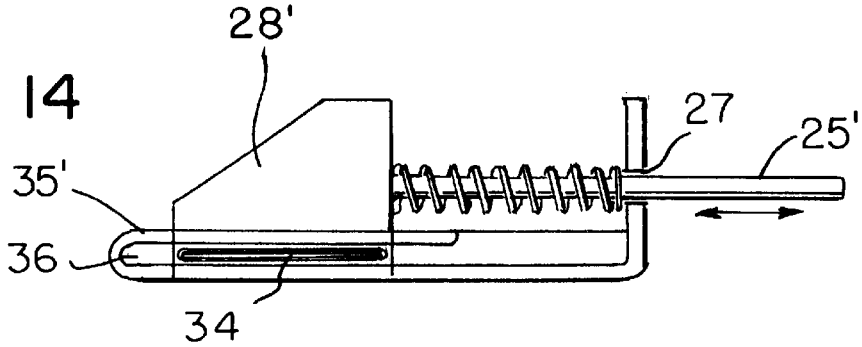
FIG. 14 is a cross-section drawing of the main elements of yet another embodiment of the present invention.

Referring finally to FIG. 14 another embodiment of the stopper mechanism utilizes guide channel 36 in case 24' with guide tab 34 of stopper wedge 28' slidably disposed therein. However this embodiment fixes guide pin 25' to stopper wedge 28' and eliminates collar 30. Guide pin 25' slides through hole 27 in unison with the sliding of stopper wedge 28'.

In the embodiments of this description, a rear hatch door of an automobile was used as an example of an opening/closing body, but the present invention need not be limited to this. The device of this invention is suitable for any opening/closing body for which vibrations need to be prevented after closing, for example, a front door, a hood, a tailgate, a trunk, or a sliding door. Also, the present invention is suitable for use with vehicles other than automobiles.

For the purpose of this description, the term stopper wedge includes any shape or material suitable for wedging against the body which is in need of vibration prevention. Shapes such as blocks, cylinders, spheres, cones, etc. and materials that are rigid, malleable, resilient, etc. are all considered within the scope of the invention as adaptable to be used as a stopper wedge element.

For the purpose of this description, the term case is not limited to a box shaped container with four sides and a bottom. A case may have any shape or configuration that fulfills the purpose of providing a support framework for the vibration prevention mechanism. For example, the case may be a channel, a carved block, a flat sheet with tabs, have the shape of a boxed canyon, etc. The cross section, for example, may be flat-bottomed- U-shaped, round-bottomed-U-shaped, V-shaped, dovetail shaped etc.

For the purpose of this description, the term guide pin is used to describe the element that constrains the movement to the stopper wedge to a specified path. The guide pin also keeps the stopper wedge in proper alignment so that it can advantageously contact the opening/closing body. A rod shaped cylinder is shown in the drawings, however, the guide pin could also be square shaped, triangle shaped, oval shaped, etc. or may even be a channel or spline.

For the purpose of this description, the spring is not limited to a coil shaped metal spring threaded onto the guide pin, but may be any resilient body of any appropriate material useful for urging the stopper wedge against the opening/closing body's contact surface. Additionally, for the purpose of this description, the contact surface can be a reinforcing plate, knob, indentation, etc. disposed at the point of contact with the stopper wedge on the opening/closing body or simply the un-reinforced surface of the opening/closing body itself.

For the purpose of this description, the collar is not limited to the disclosed donut shaped protrusion on the guide pin but may also be any protrusion that limits the spring form sliding off the guide pin and limits the guide pin from passing through the hole in the end of the case. The collar may be a pin, a knob, a bend, etc.

Additionally, for the purposes of this description, the metal plate is not limited to the shape and material described above, but may be any shape or material that is press fit into the case and provides a wear resistant surface that the stopper wedge can rub against. Also, the metal plate may be pressed into the case as described or inserted in any manner that will augment its positioning in the bottom of the case. For example, the metal plate may be inserted into the bottom of the case in a bowed configuration and then allowed to straighten causing the ends to embed in both end walls without leaving a path of entry in either of the end walls.

The disclosed invention provides the following advantages. The metal plate is pressed into the case so that both ends of the plate are embedded into the end walls of the case. Consequently, the metal plate is attached to the bottom of the case without adhesive. Also, the contact surfaces between the metal plate and the case do not require preparation by priming or de-greasing. Therefore, eliminating the adhesive process reduces the cost involved in adhesive materials and reduces the complexity of manufacture. The above vibration-preventing device's 20' caulking operations for the guide pin are eliminated in the present invention. The present invention does not require the guide pin to be fixed to the case because the spring that drives the stopper wedge simultaneously maintains the guide pin in its position. Consequently, assembly of the stopper mechanism in the case is simplified.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A vibration-preventing device for an opening/closing body in an vehicle comprising:

a guide pin spanning a case, said guide pin passing through a stopper wedge and a spring in said case;

a stopper end and a collar end of said guide pin captured in said case in two holes disposed on opposite side walls of said case;

said stopper wedge and said spring contacting said collar end of said guide pin;

said spring urging said guide pin toward a collar side wall of said case;

an incline formed downward and outward on a lower portion of said hole in a stopper side wall of said case through which a stopper end of said guide pin is inserted; and a contact surface is formed toward a collar end of said guide pin contacting said collar side wall of said case.

2. A vibration-preventing device for an opening/closing body in an vehicle as described in claim 1 further comprising:

a plate disposed on a bottom surface of said case;

said plate having a length greater than a length of said bottom surface of said case; and said plate is attached by pressing said plate into said case.

3. A vibration-preventing device for an opening/closing body in an vehicle as described in claim 2 wherein ends of said plate are sawtooth shaped.

4. A vibration-preventing device for an opening/closing body in an vehicle as described in claim 3 wherein a drainage hole is disposed at least one corner of said bottom surface of said case.

5. A vibration-preventing device for an opening/closing body in an vehicle as described in claim 3 wherein a corner on at least one end of said plate is bevelled.

6. A vibration-preventing device for an opening/closing body in an vehicle as described in claim 5 wherein a drainage hole is disposed at least one corner of said bottom surface of said case.

7. A vibration-preventing device for an opening/closing body in an vehicle as described in claim 2 wherein a corner on at least one end of said plate is bevelled.

8. A vibration-preventing device for an opening/closing body in an vehicle as described in claim 7 wherein a drainage hole is disposed at least one corner of said bottom surface of said case.

9. A vibration-preventing device comprising:

a guide pin having a collar, a stopper end, and a collar end;

said stopper end disposed in a stopper hole;

said collar end disposed in a collar contact hole;

said collar substantially larger than said collar contact hole;

a stopper end-wall, and a collar end-wall;

said stopper hole disposed in said stopper end-wall;

said collar contact hole disposed in said collar end-wall;

said guide pin spanning a distance between said stopper hole and said collar contact hole;

a stopper wedge slidably disposed on said guide pin; and a spring disposed on said guide pin between said stopper wedge and said collar, said spring simultaneously urging said stopper wedge toward said stopper hole and said collar toward said collar contact hole.

10. The vibration-preventing device of claim 9, further comprising a case having said stopper end-wall, and said collar end-wall.

11. The vibration-preventing device of claim 9 further wherein said wear resistant bottom is a metal plate press-fit into said case.

12. A vibration-preventing device, comprising:

a stopper body having a wedgable shape, a leading end, and a following end;

at least one guide pin, said at least one guide pin having an axis, a collar, a stopper end, and a collar end;

a collar contact hole disposed in a collar end-wall;

said collar end of said at least one guide pin disposed in said collar contact hole;

said stopper body slidable along a path defined by said axis of said at least one guide pin, said path having an end, said end defining a position beyond which said stopper body cannot slide;

at least one spring having a stopper contact end and a collar contact end;

said stopper contact end of said spring contacting said following end of said stopper body; and said spring biased to urge said guide pin into said collar contact hole while simultaneously urging said stopper body to move along said path in a direction lead by said leading end of said stopper wedge.

* * * * *